US005794606A

United States Patent [19]

Deak

[11] Patent Number: 5,794,606

[45] Date of Patent: Aug. 18, 1998

[54] RAM FEED AMMO BOX

[76] Inventor: Bernard A. Deak, 17370 Spanghurst Dr., Walton Hills, Ohio 44146

[21] Appl. No.: 654,354

[22] Filed: May 28, 1996

[51] Int. Cl.[6] ..... F41B 11/02

[52] U.S. Cl. ..... 124/51.1; 124/82; 89/33.17; 221/258; 221/259; 221/277

[58] Field of Search ..... 42/49.01, 87; 89/33.01, 89/33.1, 33.17, 45; 124/45, 49, 50, 51.1, 82; 221/258, 259, 277

[56] References Cited

U.S. PATENT DOCUMENTS

| | | | |
|---|---|---|---|
| 1,332,993 | 3/1920 | Moore et al. | 124/51.1 X |
| 1,743,576 | 1/1930 | Smith | 124/49 X |
| 2,951,422 | 9/1960 | Bobkowski | 89/33.1 |
| 3,248,008 | 4/1966 | Meierjohan | 221/277 X |
| 3,695,246 | 10/1972 | Filippi et al. | 124/72 |
| 3,815,567 | 6/1974 | Serra | 124/78 |
| 3,838,663 | 10/1974 | Focke | 116/215 |
| 3,844,267 | 10/1974 | Mohr | 124/78 |
| 3,867,921 | 2/1975 | Politzer | 124/50 X |
| 3,998,357 | 12/1976 | Levasseur | 221/21 |
| 4,193,591 | 3/1980 | Paulson | 124/78 |
| 5,110,008 | 5/1992 | Moulding, Jr. et al. | 221/259 |
| 5,267,501 | 12/1993 | Shillig | 89/1.51 |
| 5,282,454 | 2/1994 | Bell et al. | 124/49 |
| 5,505,188 | 4/1996 | Williams | 124/49 X |

*Primary Examiner*—John A. Ricci

*Attorney, Agent, or Firm*—Pearne, Gordon, McCoy & Granger LLP

[57] ABSTRACT

A feed mechanism for use with a paintball gun having an infeed tube for receiving paintballs that are to be fired from the paintball gun. The feed mechanism includes a storage container, a feeder tube, a feed structure, an electric motor and a switch for automatically stopping the electric motor. The storage container holds paintballs and has a bottom wall with a feeder opening therein. The feeder tube is connected to the infeed tube so as to form a feed path. The feed structure has a passage that extends between the feeder opening of the storage container and the feeder tube. The passage is defined in part by a first surface secured to the periphery of a first wheel and a second surface secured to the periphery of a second wheel. The first and second surfaces have a spacing therebetween that is smaller than the diameter of the paintballs. The first and second surfaces are composed of a deformable material that grips paintballs at the feeder opening. The electric motor rotates the first wheel towards the feeder tube so as to move paintballs gripped by the first and second surfaces through the passage and into the feeder tube. The switch automatically stops the electric motor when there is a jam in the feed path.

20 Claims, 3 Drawing Sheets

RAM FEED AMMO BOX

BACKGROUND OF THE INVENTION

1. Field of the Invention

This invention relates to paintball guns in general and, more particularly, to feed devices for storing and sequentially feeding paintballs to a paintball gun.

2. Description of the Related Art

Paintball guns are most commonly used to play a war game wherein two teams of players try to capture one another's flags. The war game is played on a large field having two geographically separated bases. Each team is assigned a color and a base. Each team's base prominently displays a flag with the team's color. All of the players on a team have a paintball gun that shoots paintballs, which are gelatin covered spherical capsules filled with paint. Initially, all of the players are located at their respective bases. When a signal is given, players on a team advance towards the opposing team's base in the hopes of retrieving the opposing team's flag without being knocked out of the war game. A player is knocked out of the war game when the player is hit by a paintball fired from an opposing player's gun, provided the paintball ruptures and leaves a "splat" of paint on the player.

Broadly, there are three different types of paintball gun: single shot, semi-automatic and automatic. All three types of gun generally have a barrel, a feed mechanism, a feed path, a firing chamber, a canister of a pressurized gas such as $CO_2$ and means for introducing the pressurized gas into the firing chamber. The firing chamber receives a paintball that is gravity fed through the feed path. The means for introducing the compressed gas into the firing chamber will usually include a trigger and a firing valve having an inlet in communication with the canister of pressurized gas. When the trigger is actuated by moving the trigger from an inactive position to a firing position, the firing valve opens and closes so as to allow a burst of pressurized gas to enter the firing chamber. The burst of compressed gas contacts the paintball and forcefully ejects it out of the firing chamber. The paintball passes through the barrel and into the outside environment.

Although all three types of paintball gun have the same general structure and operation set forth above, the manner in which the paintball is introduced into the feed path and subjected to the pressurized gas differs between the three types of paintball guns. In a single shot paintball gun, the feed mechanism has to be manually actuated to introduce a paintball into the feed path. Typically, the feed mechanism is a bolt action device or pump action device in communication with a feed opening in the paintball gun. Paintballs are introduced into the feed opening manually or by operation of gravity. In the latter case, a container for holding paintballs is removably mounted on the paintball gun above the feed opening.

Once the paintball is introduced into the feed path and travels under the force of gravity to the firing chamber, the trigger is actuated and a single burst of pressurized gas is introduced into the firing chamber to eject the paintball. In some single-shot paintball guns the firing valve in the feed mechanism is mechanically opened and closed by a linkage connected to the trigger. In other single-shot paintball guns, the firing valve is solenoid operated and is electrically connected to the trigger. In both types of single-shot paintball gun, however, the firing valve is only opened and closed once when the trigger is moved to the firing position. Usually the trigger is spring-biased so as to automatically return to the inactive position. In order to fire another paintball, an operator must again manually actuate the feed mechanism to move another paintball into the feed path.

In semi-automatic paintball guns as in single-shot paintball guns, the firing valve in the feed mechanism can be mechanically actuated or solenoid actuated. The trigger is also connected to the firing valve such that when the trigger is moved to the firing position, the firing valve will only open and close once. Semi-automatic paintball guns, however, have a feed mechanism that continuously introduces paintballs into the feed path. Thus, semi-automatic paintball guns can sequentially fire paintballs as fast as the trigger can be actuated and released.

In automatic paintballs guns, the firing valve repeatedly opens and closes as long as the trigger is held in the firing position. In automatic paintball guns, the firing valve in the feed mechanism is a solenoid valve that continuously opens and closes when it is provided with electricity. The solenoid valve is provided with electricity through a circuit connected to the trigger. The trigger completes the circuit and thereby provides the solenoid valve with electricity when the trigger is moved to the firing position. The circuit continues to provide the solenoid valve with electricity for as long as the trigger is held in the firing position. Automatic paintball guns also have a feed mechanism that continuously introduces paintballs into the feed path.

Typically, semi-automatic and automatic paintball guns have a feed mechanism that includes a bulk loader device that sequentially feeds paintballs into the feed path by gravity. A conventional prior art bulk loader includes a feeder passage with first and second ends and a housing with a top inlet opening and a bottom outlet opening. The housing is positioned above and to one side of the paintball gun. The first end of the feeder passage is secured to the housing around the periphery of the outlet opening and the second end is connected to the feed path.

The housing is adapted to internally store a large quantity of paintballs. During the operation of the paintball gun, the paintballs in the housing drop through the outlet opening and into the feeder passage. Eventually, a stack of paintballs forms in the feeder passage and the feed path. When a paintball passes into the firing chamber from the feed path, the stack moves downward and another paintball drops through the outlet opening and onto the stack. In this manner, paintballs are sequentially fed into the feed path by gravity and without manual activation.

Jams routinely occur in the housing at the bottom outlet opening because multiple paintballs often move towards the outlet opening at the same time and become wedged against each other, thereby blocking the outlet opening. With a prior art bulk loader, an operator would typically clear a jam by inverting the paintball gun and forcibly shaking the housing so as to dislodge the paintballs. This method of clearing jams is undesirable because it interrupts the use of the paintball gun and can give-away the location of a concealed player. In addition, the operator has to hold his or her hand over the top inlet opening when the paintball gun is inverted so as to prevent paintballs from falling out of the top inlet opening. Oftentimes, the operator is unsuccessful and paintballs spill out of the bulk loader and onto the ground.

Several prior art bulk loaders have been developed to address the jamming problem described above. One such bulk loader is disclosed in U.S. Pat. No. 5,282,454 to Bell et al, incorporated herein by reference. The Bell bulk loader has a housing with a bottom opening leading to a feed passage. An optical sensor is disposed within the feed passage and an agitator paddle is rotatably mounted to the bottom of the housing near the bottom opening. The optical sensor determines that there is a jam in the housing when the optical sensor detects a gap in the feed passage. The agitator paddle is connected to a motor that is in communication with the optical sensor. When the optical sensor detects a jam at the bottom opening of the housing, the optical sensor activates the motor, causing the agitator paddle to rotate and dislodge the paintballs.

The Bell bulk loader does not prevent jams and can only detect jams in the housing. In addition, agitator paddles may break paintballs if the paintballs are wedged together tightly. Accordingly, there is a need in the art for a feed mechanism that prevents jams without breaking paintballs and detects jams downstream of the housing. The present invention is directed to such a feed mechanism.

SUMMARY OF THE INVENTION

It therefore would be desirable, and is an advantage of the present invention, to provide a feed mechanism with a housing for storing paintballs wherein the feed mechanism prevents jams without breaking paintballs and detects jams downstream of the housing. In accordance with the present invention, a feed mechanism is provided for use with a gun is having an infeed tube for receiving paintballs that are to be fired from the gun. The feed mechanism includes a storage container, a feeder tube, a feed structure, moving means and stopping means. The storage container holds paintballs and has a wall with a feeder opening therein. The feeder tube connects to the infeed tube so as to form a feed path. The feed structure has a passage extending between the feeder opening of the storage container and the feeder tube. The passage is defined in part by first and second surfaces having a spacing therebetween that is smaller than the diameter of the paintballs. The first surface is composed of a deformable material that grips paintballs at the feeder opening. The moving means moves the first surface towards the feeder tube so as to move paintballs gripped by the first surface through the passage and into the feeder tube. The stopping means automatically stops the moving means when there is a jam in the feed path.

Also provided in accordance with the present invention is a feed mechanism that includes a storage container, a feeder tube, a feed structure and a motor. The feed mechanism is for use with a gun having an infeed tube for receiving paintballs that are to be fired from the gun. The storage container holds paintballs and has a wall with a feeder opening therein. The feeder tube connects to the infeed tube so as to form a feed path. The feed structure has a passage extending between the feeder opening of the storage container and the feeder tube. The passage is defined in part by a first surface secured to the periphery of a first wheel and by a second surface. The first and second surfaces have a spacing therebetween that is smaller than the diameter of the paintballs. The first surface is composed of a deformable material that grips paintballs at the feeder opening. The motor rotates the first wheel towards the feeder tube so as to move paintballs gripped by the first surface through the passage and into the feeder tube.

Also provided in accordance with the present invention is a gun for firing paintballs. The gun has a canister, an infeed tube and a feed mechanism. The canister holds compressed gas that fires paintballs out of the gun. The infeed tube receives paintballs to be fired out of the gun. The feed mechanism includes a storage container, a feeder tube, a feed structure, an electric motor, a battery and a means for cutting off electric power to the electric motor. The storage container holds paintballs and has a wall with a feeder opening therein. The feeder tube is connected to the infeed tube so as to form a feed path. The feed structure has a passage that extends between the feeder opening of the storage container and the feeder tube. The passage is defined in part by a first surface secured to the periphery of a first wheel and a second surface secured to the periphery of a second wheel. The first and second surfaces have a spacing therebetween that is smaller than the diameter of the paintballs. The first and second surfaces are composed of a deformable material that grips paintballs at the feeder opening. The electric motor rotates the first wheel towards the feeder tube so as to move paintballs gripped by the first and second surfaces through the passage and into the feeder tube. The battery provides electric power to the electric motor. The means for cutting-off electric power stops the supply of electric power to the electric motor when there is a jam in the feed path.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
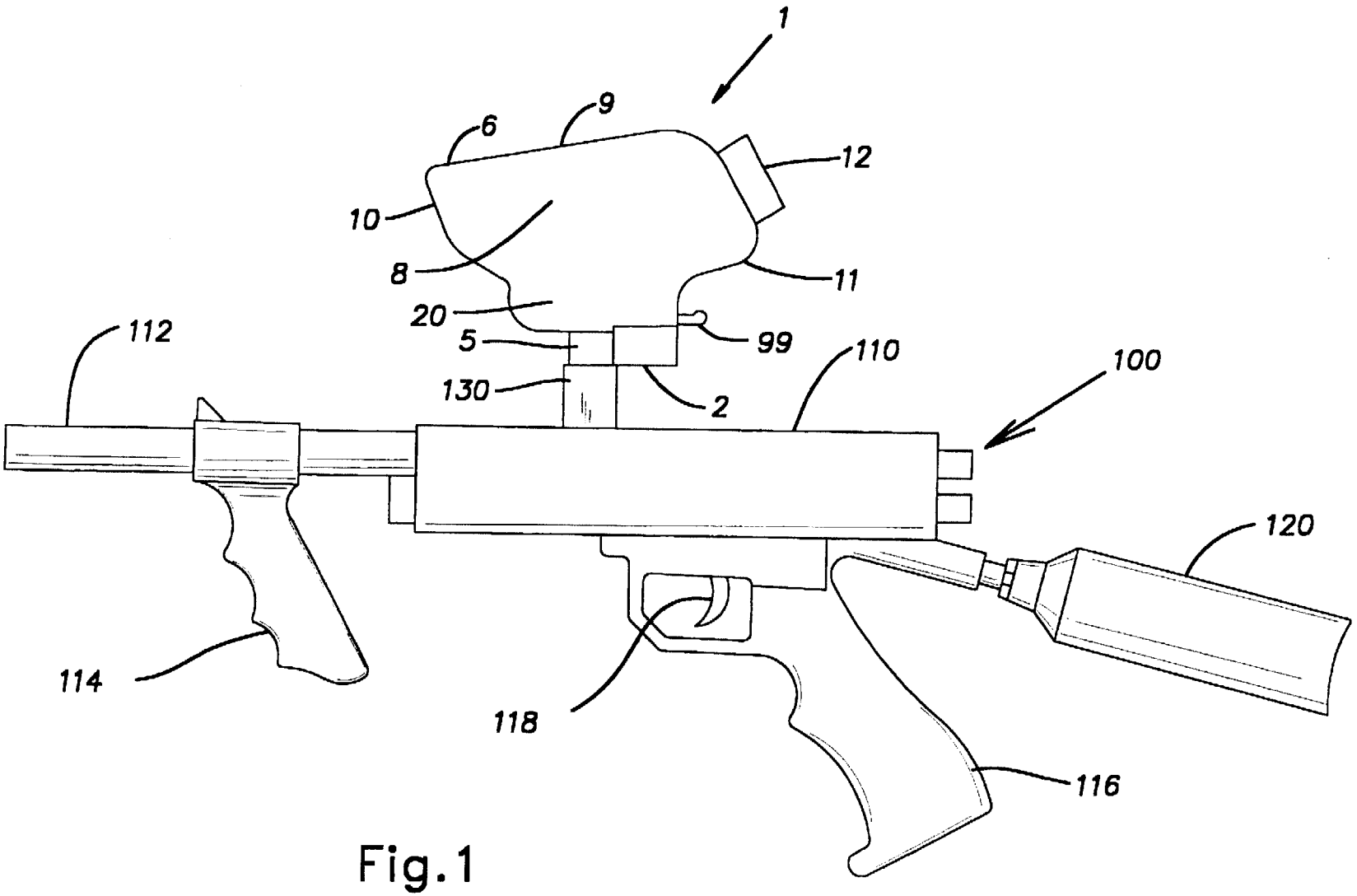
FIG. 1 shows a paintball gun having a ram feed ammo box embodied in accordance with the present invention.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1, there is shown a paintball gun 100 having a bulk loader or ram feed ammo box 1 embodied in accordance with the present invention. The paintball gun 100 is of the automatic type. It should be appreciated, however, that the ram feed ammo box 1 of the present invention can also be used with a semi-automatic paintball gun. The paintball gun 100 has a body 110, a barrel 112, a front handgrip 114, a central handgrip 116 and a compressed gas cylinder 120. The central handgrip 116 projects downward from the body 110 and has a trigger 118. The barrel 112 is hollow and projects outward from the front of the body 110. Projecting downward from the barrel 112 is the front handgrip 114. The compressed gas cylinder 120 is secured to the bottom rear of the body 110. The compressed gas cylinder 120 angles downward and to the rear of the body 110 so as to form a rear stock. The compressed gas cylinder 120 contains compressed $CO_2$ gas and is in communication with a firing valve (not shown) disposed in the interior of the body 110.

The paintball gun 100 has an infeed tube 130 with an interior end (not shown) that is in communication with a firing chamber (not shown) in the interior of the body 110.

The infeed tube 130 extends through the interior of the body 110 and exits through an opening in the top of the body 110. Outside of the body 110, the infeed tube 130 extends upward and then curves to one side of the body 110. After extending to the one side for a distance, the infeed tube 130 then curves upward again and is secured to the ram feed ammo box 1. The infeed tube 130 provides a route through which paintballs can travel from the ram feed ammo box 1 to the firing chamber.

An opening in the firing chamber is fitted with the firing valve. The firing valve is a conventional solenoid-operated valve that continuously opens and closes when it is provided with electricity. The firing valve is provided with electricity through a circuit containing the trigger 118. When the trigger 118 is in an inactive position shown in FIG. 1, the circuit is open and electricity does not flow to the firing valve. When the trigger 118 is actuated and moved to a firing position, the circuit closes and thereby provides electricity to the firing valve. The circuit remains closed and continues to provide the firing valve with electricity for as long as the trigger 118 is held in the firing position. The continuous provision of electricity to the firing valve causes the firing valve to repeatedly open and close. As a result, bursts of compressed $CO_2$ gas continuously enter the firing chamber and eject paintballs that enter the firing chamber through the infeed tube. As will be described more fully below, paintballs stored in the ram feed ammo box 1 are continuously pulled into the infeed tube 130 and travel under the force of gravity to the firing chamber so as to be continually ejected from the paintball gun 100 by the bursts of compressed $CO_2$ gas.

Figure 2:
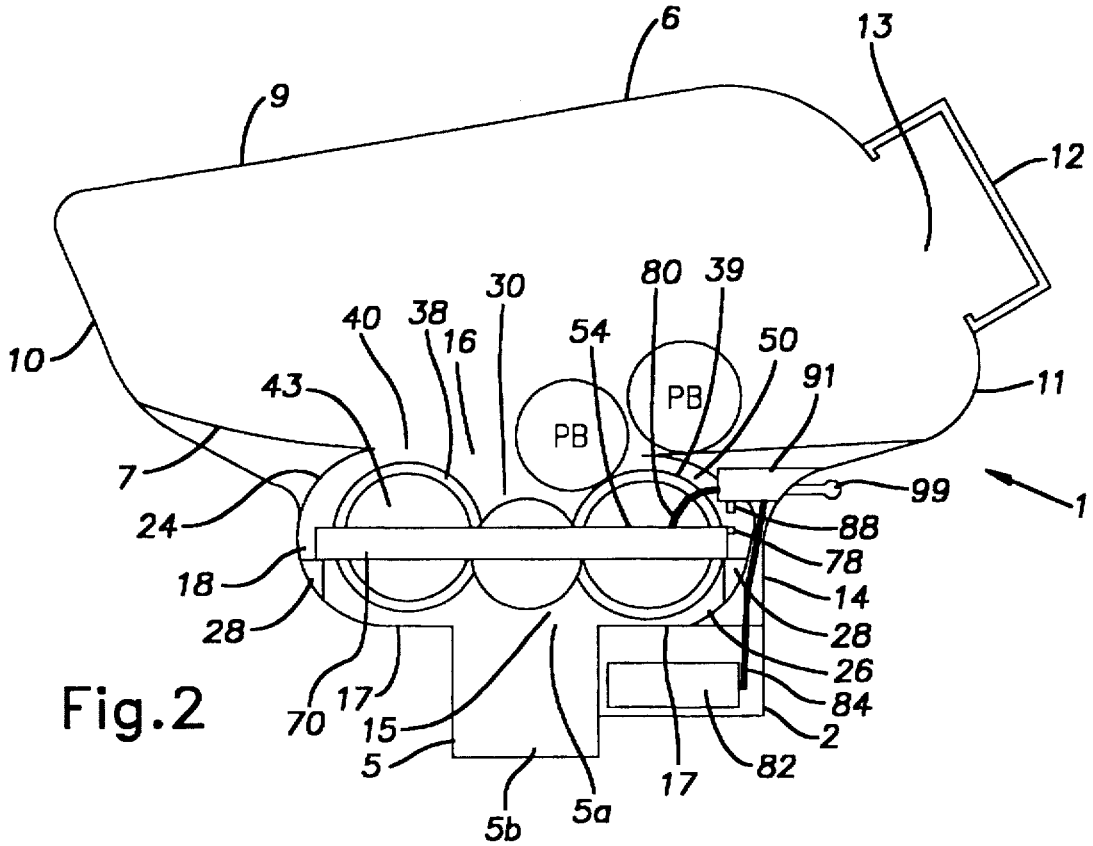
FIG. 2 shows a sectional side view of the ram feed ammo box.

Referring now to FIG. 2 there is shown a sectional side view of the ram feed ammo box 1. The ram feed ammo box 1 is composed of molded plastic and has a hollow interior. The ram feed ammo box 1 generally has a battery housing 2, a feeder tube 5, an irregular-shaped storage container 6 and a feed structure 14. The storage container 6 generally has opposing arcuate side walls 8 (shown in FIG. 1), a sloping top wall 9, a sloping front wall 10, an irregular rear wall 11 and a bottom wall 7. The bottom wall 7 slopes downward towards a feeder opening 16. The storage container 6 holds a plurality of paintballs PB for subsequent feeding into the infeed tube 130 of the paintball gun 100. The paintballs PB have a diameter of approximately 0.7 inches, which is the most common diameter used for paintballs in the "war game" industry. Accordingly, the paintballs PB can be referred to as "regular-sized".

An input opening 13 is provided to permit the paintballs PB to be loaded into the storage container 6. The input opening 13 is located near the top of the storage container 6 and is fitted with a removable cap 12. The cap 12 prevents paintballs PB from spilling out of the storage container 6 if the paintball gun 100 is inverted. Paintballs PB held in the storage container 6 are fed through the feed structure 14 and into the feeder tube 5.

The feeder tube 5 has an inlet end **5*a* and an outlet end 5*b*. The outlet end 5*b* is telescopically received in the infeed tube 130. The exterior diameter of the outlet end 5*b* is only slightly smaller than the interior diameter of the infeed tube 130 so as to provide a secure fit between the feeder tube 5 and the infeed tube 130. The periphery of the inlet end 5*a* of the feeder tube 5 is adjoined to the feed structure 14 around an outlet opening 15. The feeder tube 5 is hollow and provides a passage from the feed structure 14 to the infeed tube 130**.

The feed structure 14 is located between the storage container 6 and the feeder tube 5. The feed structure 14 has an inner periphery that defines a cavity 30. The inner periphery is defined by a bottom wall 17, a front wall 18, a front concave wall 24, a rear concave wall 26 and a pair of opposing side walls 20 (shown in FIG. 1). A ledge 28 extends around the inner periphery of the feed structure 14. The ledge 28 has a top planar surface that projects inward from the front wall 18, the rear concave wall 26 and the side walls 20.

Figure 3:
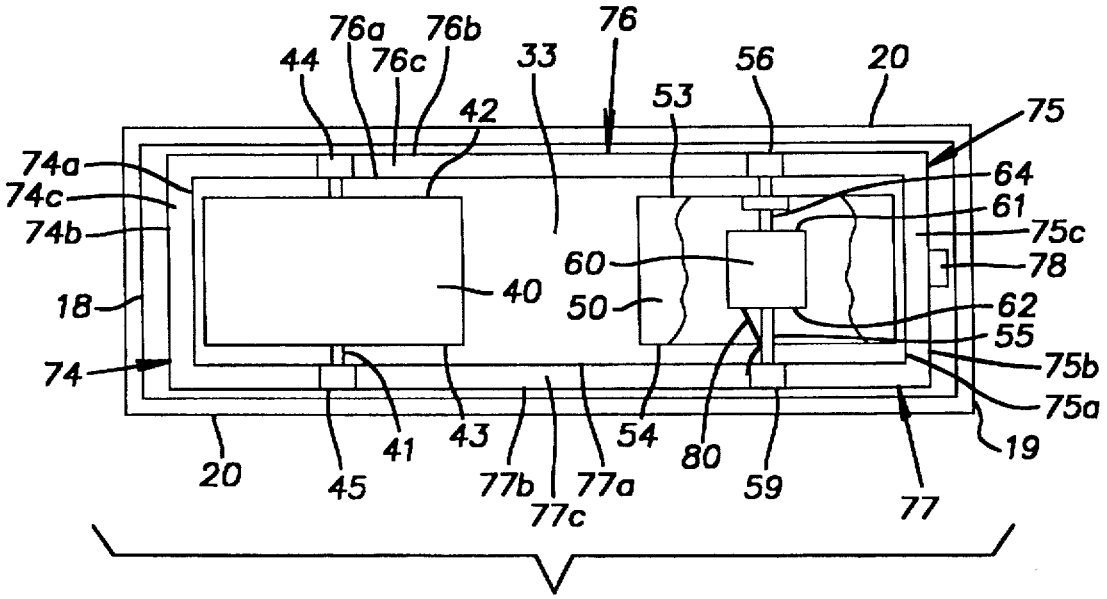
FIG. 3 shows a top view of front and rear wheels mounted in the ram feed ammo box.

Referring now also to FIG. 3, a frame 70 is disposed within the cavity 30 and is supported by the ledge 28 above the bottom wall 17. The frame 70 is composed of plastic and has a generally rectangular shape. The frame 70 includes a front portion 74, a rear portion 75, a first side portion 76 and a second side portion 77, which together define an inner void having a substantially rectangular shape. A lip 78 extends rearward from the rear portion 75. The front and rear portions 74, 75 and the first and second side portions 76, 77 are each channel-shaped and respectively have inner flanges **74*a*, 75*a*, 76*a*, 77*a* and outer flanges 74*b*, 75*b*, 76*b*, 77*b*, 78*b* that respectively extend upward from planar members 74*c*, 75*c*, 76*c*, 77*c***.

A first front socket 44 and a first rear socket 56 are disposed within the first side portion 76. Similarly, a second front socket 45 and a second rear socket 59 are disposed within the second side portion 77. The first front socket 44 and the first rear socket 56 have hollow interiors that are respectively aligned with front and rear openings in the inner flange **76*a*, while the second front socket 45 and the second rear socket 59 have hollow interiors that are respectively aligned with front and rear openings in the inner flange 77*a*. The first front socket 44 is laterally aligned with the second front socket 45 and the first rear socket 56 is laterally aligned with the second rear socket 59**.

The frame 70 is vertically movable within the cavity 30 between lower and upper positions. In the lower position, the frame 70 rests upon the ledge 28, while in the upper position, the frame 70 abuts a cut-off pushbutton 88. When the ram feed ammo box 1 is in an upright position as shown in FIGS. 1, 2, gravitational forces urge the frame 70 to the lower position. However, as will be discussed in more detail later, a jam in the feeder tube 5 or the infeed tube 130 will cause the frame 70 to move to the upper position.

Front and rear wheels 40, 50 are disposed within the inner void and are rotatably secured to the first and second side portions 76, 77 of the frame 70. The surfaces of the front and rear wheels 40, 50 are respectively fitted with neoprene layers 38, 39. The front and rear wheels 40, 50 are spaced apart so as to form a passage 33 (shown in FIG. 3) defined in part by the neoprene layers 38, 39. The spacing between the neoprene layers 38, 39 and, thus, the width of the passage 33 is smaller than the diameter of the paintballs PB. When the frame 70 is resting upon the top planar surface of the ledge 28, the front and rear wheels 40, 50 are spaced inward from the periphery of the feed structure 14 and, thus, can rotate freely.

The front wheel 40 is cylindrical and has a first end wall 42 and a second end wall 43. A center axis 41 extends through the front wheel 40 and has first and second portions that respectively project outward from the first and second end walls 42, 43. The first portion is journaled through the front opening in the inner flange **76*a* and extends into the first front socket 44, while the second portion is journaled through the front opening in the inner flange 77*a* and extends into the second front socket 45. The first and second portions of the center axis 41 are able to freely rotate within the first and second sockets 44, 45**. In this manner, the front wheel 40 is rotatably secured to the first and second side portions 76, 77 of the frame 70.

In FIG. 3, a portion of the rear wheel 50 is cut-away. The rear wheel 50 is cylindrical and has a first end wall 53 and a second end wall 54. The rear wheel 50 has a hollow interior containing a motor 60. Projecting out from a first end 61 of the motor 60 is a shaft 64. The shaft 64 is secured to the first end wall 53 and extends through an opening contained therein. The shaft 64 is journaled through the rear opening in the inner flange 76*a* and extends into the first rear socket 56. The shaft 64 is able to freely rotate within the first rear socket 56.

A support rod 55 is secured to a second end 62 of the motor 60 and passes through an opening in the second end wall 54. The support rod 55 extends through the rear opening in the inner flange 77*a* and extends into the second rear socket 59. The support rod 55 is firmly secured to the interior of the second rear socket 59 and, thus, cannot rotate therein.

Figure 4:
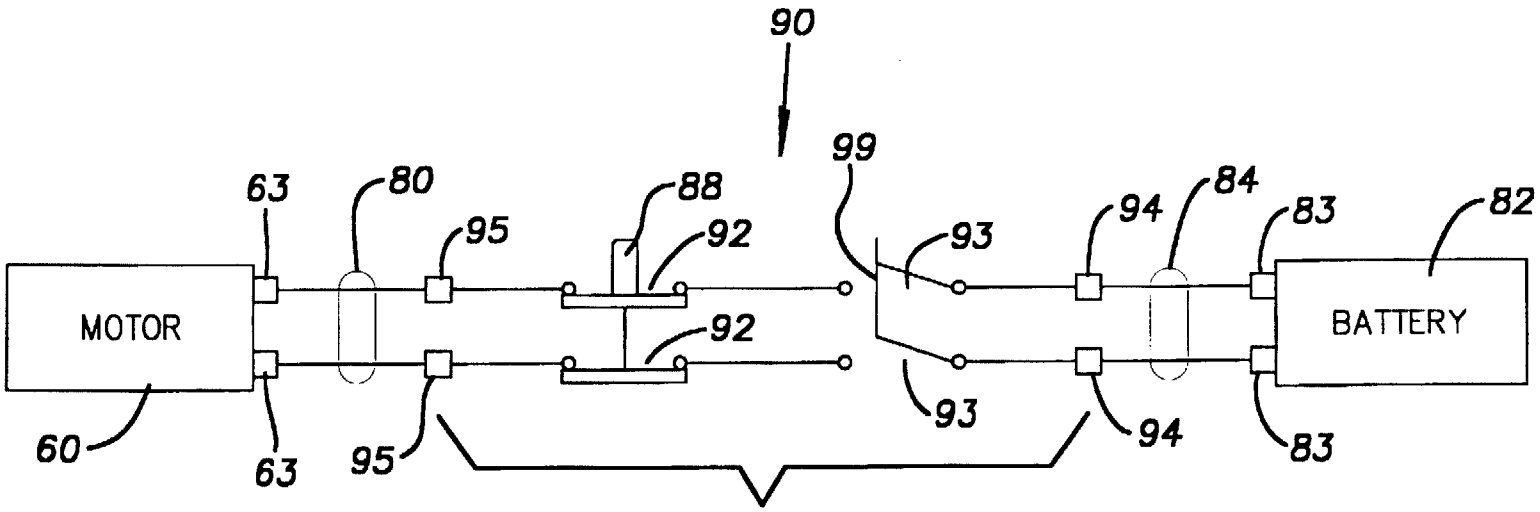
FIG. 4 shows an electrical schematic for a switch mechanism mounted in the ram feed ammo box.

Referring now to FIG. 4, the motor 60 is a conventional DC motor and receives electrical power through a power circuit that includes motor conductors 80, a switch mechanism 90, battery conductors 84 and a battery 82. The motor conductors 80 and the battery conductors 84 each have input ends and output ends. The motor conductors 80 are connected at their input ends to terminals 63 on the motor 60 and pass through the opening in the second end wall 54 of the rear wheel 50. From the rear wheel 50, the motor conductors 80 extend upward to the switch mechanism 90 and are connected at their output ends to output terminals 95 on the switch mechanism 90. The battery conductors 84 are connected at their output ends to input terminals 94 on the switch mechanism 90. From the switch mechanism 90, the battery conductors 84 extend down to the battery 82 and are connected at their input ends to terminals 83 on the battery 82.

The switch mechanism 90 is disposed within the feed structure 14 and controls the electrical connection of the motor conductors 80 to the battery conductors 84 and, thus, controls the electrical connection of the battery 82 to the motor 60. The switch mechanism 90 has two pushbutton contact pairs 92 and two switch contact pairs 93 enclosed within a housing 91. Each of the pushbutton contact pairs 92 and each of the switch contact pairs 93 have an input contact and an output contact. The input contacts of the switch contact pairs 93 are connected to the input terminals 94, while the output contacts of the pushbutton contact pairs 92 are connected to the output terminals 95. In between, the output contacts of the switch contact pairs 93 are connected to the input contacts of the pushbutton contact pairs 92. Thus, the switch mechanism 90 electrically connects the battery 82 to the motor 60 only when the pushbutton contact pairs 92 and the switch contact pairs 93 are all closed.

The pushbutton contact pairs 92 are closed by the cut-off pushbutton 88 that projects downward from the housing 91 and is movable between a retracted position and an extended position. In the extended position, the cut-off pushbutton 88 closes the pushbutton contact pairs 92, while in the retracted position, the cut-off pushbutton 88 opens the pushbutton contact pairs 92. The cut-off pushbutton 88 is spring biased towards the extended position and, thus, will only open the pushbutton contact pairs 92 for as long as the cut-off pushbutton 88 is retained in the retracted position.

The cut-off pushbutton 88 is aligned with the lip 78 on the rear portion 75 of the frame 70. When the frame 70 is in the lower position, the lip 78 is spaced below the cut-off pushbutton 88, which is in the extended position. When the frame 70 is moved to the upper position, however, the lip 78 depresses the cut-off pushbutton 88 to the retracted position.

The switch contact pairs 93 are closed by a slide switch 99 that projects rearward from the housing 91 and extends through an aperture in the feed structure 14. The slide switch 99 is laterally movable between an "on" position and an "off" position. In the "on" position, the slide switch 99 closes the switch contact pairs 93, while in the "off" position, the slide switch 99 opens the switch contact pairs 93. The slide switch 99 is not biased toward either position and, thus, must be manually moved between the "on" and the "off" positions.

In the description of the operation of the ram feed ammo box 1 and the paintball gun 100 that follows, it should be assumed that the trigger 118 is being held in the firing position unless otherwise noted.

In order to begin the operation of the ram feed ammo box 1, the slide switch 99 is moved to the "on" position, which closes the switch contact pairs 93 and permits the power circuit to provide electric power from the battery 82 to the motor 60. When the motor 60 receives electric power from the battery 82, the shaft 64 rotates counterclockwise (as viewed from the second end wall 54 of the rear wheel 50 shown in FIG. 2). Since the shaft 64 is secured to the first end wall 53 of the rear wheel 50, the rear wheel 50 rotates counterclockwise around the support rod 55. The motor 60 is held stationary within the rotating rear wheel 50 by the support rod 55.

Paintballs PB at the bottom of the storage container 6 contact the neoprene layer 39 of the rear wheel 50. As a result, the neoprene layer 39 compresses and grips the paintballs PB. When the rear wheel 50 is rotating counterclockwise, the neoprene layer 39 moves into the passage 33 between the front and rear wheels 40, 50 and towards the outlet opening 15 in the feed structure 14. As a result, the paintballs PB gripped by the neoprene layer 39 are moved into the passage 33 and towards the outlet opening 15. When the paintballs PB enter the passage, they contact the neoprene layer 38 of the front wheel 40, causing the neoprene layer 38 to compress and grip the paintballs PB. The downward movement of the paintballs PB cause the front wheel 40 to rotate clockwise (as viewed from the second end wall 43). The counter-rotation of the front and rear wheels 40, 50 moves the paintballs PB through the passage 33 and into the inlet end 5*a* of the feeder tube 5.

It should be appreciated that the neoprene layers 38, 39 of the front and rear wheels 40, 50 are of a sufficient thickness to permit the ram feed ammo box 1 to feed paintballs of varying size to the paintball gun 100. If paintballs larger than the paintballs PB are moved through the passage, the neoprene layers 38, 39 will compress farther than with the paintballs PB. However, if paintballs smaller than the paintballs PB are moved through the passage, the neoprene layers 38, 39 will not compress as far as with the paintballs PB. Thus, the ram feed ammo box 1 can feed paintballs both smaller and larger than the paintballs PB, which are regular-sized.

The paintballs PB travel under the force of gravity through the feeder tube 5 and into the infeed tube 130. The feed tube 5 in combination with the infeed tube 130 shall hereinafter be referred to as the "feed path". The paintballs PB travel through the infeed tube 130 to the firing chamber. Inside the firing chamber, the paintballs PB are contacted by bursts of compressed $CO_2$ gas, causing the paintballs PB to be ejected out of the firing chamber, through the barrel 112 and into the outside environment.

As the paintballs PB travel through the feed path, they may become wedged together so as to form a jam that prevents subsequent paintballs PB from progressing through the feed path. Such a jam can be precipitated by the breakage of a paintball PB in the feed path. If a jam occurs, a chain of paintballs PB forms in the feed path and backs-up into the passage 33 between the front and rear wheels 40, 50. When the chain of paintballs PB prevents the front and rear wheels 40, 50 from moving any more paintballs PB into the feeder tube 5, the torque produced by the rear wheel 50 causes the rear wheel 50 and, thus, the frame 70 to climb up the chain of paintballs PB. As the frame 70 moves or "floats" upward, the lip 78 on the frame 70 makes contact with the cut-off pushbutton 88 and depresses the cut-off pushbutton 88 to the retracted position. As described earlier, the movement of the cut-off pushbutton 88 to the retracted position opens the pushbutton contact pairs 92 and cuts off power to the motor 60. As a result, the motor 60 stops operating and the rear wheel 50 stops exerting torque on the chain of paintballs 90. In order to restart the flow of electric power to the motor 60, the chain of paintballs PB in the feed path must be cleared so as to permit the frame 70 to move downward to the lower position, which, in turn allows the cut-off pushbutton 88 to move to the extended position.

Although the preferred embodiments of this invention have been shown and described, it should be understood that various modifications and rearrangements of the parts may be resorted to without departing from the scope of the invention as disclosed and claimed herein. For example, the trigger 118 can be used to close the switch contact pairs 93 instead of the slide switch 99. In this manner, the flow of electrical power to the motor 60 and, thus, the rotation of the rear wheel 50, can be started when the trigger 118 is moved to the firing position. Another modification that can be made is using other deformable material, such as natural rubber, to cover the front and rear wheels 40, 50. Still another modification that can be made is the addition of a second motor for rotating the front wheel 40. In the alternative, either the front wheel 40 or the rear wheel 50 can be removed and replaced with a stationary wall. Of course, the remaining wheel would have to be motorized. Still another alternative would be to remove both the front and rear wheels 40, 50 and replace them with a conveyor belt.

What is claimed is:

1. A feed mechanism for use with a gun having an infeed tube for receiving paintballs that are to be fired from the gun, said feed mechanism comprising:

a storage container for holding paintballs, said storage container having a wall with a feeder opening therein;

a feeder tube for connection to the infeed tube so as to form a feed path;

a feed structure having a passage extending between the feeder opening of the storage container and the feeder tube, said passage being defined in part by first and second surfaces having a spacing therebetween that is smaller than the diameter of the paintballs, said first surface being composed of a deformable material that grips paintballs at the feeder opening;

means for moving the first surface towards the feeder tube so as to move paintballs gripped by the first surface through the passage and into the feeder tube; and means for automatically stopping the moving means when there is a jam in the feed path.

2. The feed mechanism of claim 1 wherein the first surface is secured to the periphery of a first wheel.

3. The feed mechanism of claim 2 wherein the moving means comprises an electric motor for rotating the first wheel towards the feeder tube.

4. The feed mechanism of claim 3 wherein the second surface is secured to the periphery of a second wheel, said second surface being composed of the deformable material.

5. The feed mechanism of claim 4 wherein the deformable material composing the first and second surfaces is neoprene.

6. The feed mechanism of claim 4 wherein the first and second wheels are cylindrical.

7. The feed mechanism of claim 4 wherein the feed structure further comprises a frame to which the first and second wheels are rotatably mounted, said frame being movable from a lower position to an upper position in response to an obstruction in the feed path when the first wheel is rotating, said obstruction forming a chain of paintballs that backs up into the passage, thereby causing the first wheel and, thus, the frame to climb up the chain of paintballs to the upper position.

8. The feed mechanism of claim 7 wherein the moving means further comprises a battery for providing electric power to the electric motor.

9. The feed mechanism of claim 8 wherein the automatic stopping means comprises a switch mechanism interconnected between the battery and the electric motor, said switch mechanism controlling connection of electric power to the electric motor in response to movement of the frame between the lower and upper positions, said switch mechanism connecting electric power to the electric motor when the frame is in the lower position and disconnecting electric power to the electric motor when the frame is in the upper position.

10. A feed mechanism for use with a gun having an infeed tube for receiving paintballs that are to be fired from the gun, said feed mechanism comprising:

a storage container for holding paintballs, said storage container having a wall with a feeder opening therein;

a feeder tube for connection to the infeed tube so as to form a feed path;

a first wheel having an outer periphery;

adjacent first and second surfaces disposed between the feeder opening of the storage container and the feeder tube, said first surface being disposed upon at least a portion of the first wheel and contacting paintballs at the feeder opening;

a motor for rotating the first wheel to move paintballs contacted by the first surface between the first and second surfaces and into the feeder tube; and a shut-off apparatus connected to the motor and operable to stop automatically the motor when there is a jam in the feed path.

11. The feed mechanism of claim 10 wherein the shut-off apparatus comprises:

a structure connected to the first wheel, said structure being movable from a first position to a second position in response to an obstruction in the feed path; and a switch mechanism electrically connected to the motor and positioned so as to be contacted by the structure when the structure moves to the second position, said switch mechanism being operable to disconnect electric power to the motor when contacted by the structure.

12. The feed mechanism of claim 11 wherein the second surface is disposed upon at least a portion of a periphery of a second wheel.

13. The feed mechanism of claim 12 wherein the first and second surfaces are composed of neoprene.

14. The feed mechanism of claim 12 wherein the structure comprises a frame to which the first and second wheels are rotatably mounted, said frame being movable from the first position to the second position in response to the jam in the feed path when the first wheel is rotating, said jam forming a chain of paintballs that backs up into the passage, thereby causing the first wheel and, thus, the frame to climb up the chain of paintballs to the second position.

15. The feed mechanism of claim 12 wherein the first and second surfaces are separated by a spacing that is smaller than the diameter of the paintballs; and wherein the first surface is secured to the outer periphery of the first wheel and the second surface is secured to the outer periphery of the second wheel.

16. The feed mechanism of claim 10 further comprising a battery for providing electric power to the motor.

17. A gun for firing paintballs, said gun comprising:

a canister for holding compressed gas that fires paintballs out of the gun;

an infeed tube for receiving paintballs to be fired out of the gun; and a feed mechanism comprising:

a storage container for holding paintballs, said storage container having a wall with a feeder opening therein;

a feeder tube connected to the infeed tube so as to form a feed path;

a feed structure having a passage extending between the feeder opening of the storage container and the feeder tube, said passage being defined in part by a first surface secured to the periphery of a first wheel and a second surface secured to the periphery of a second wheel, said first and second surfaces having a spacing therebetween that is smaller than the diameter of the paintballs, said first and second surfaces being composed of a deformable material that grips paintballs at the feeder opening;

an electric motor for rotating the first wheel towards the feeder tube so as to move paintballs gripped by the first and second surfaces through the passage and into the feeder tube;

a battery for providing electric power to the electric motor; and means for cutting-off electric power to the electric motor when there is a jam in the feed path.

18. The gun of claim 17 wherein the feed structure further comprises a frame to which the first and second wheels are rotatably mounted, said frame being movable from a lower position to an upper position in response to an obstruction in the feed path when the first wheel is rotating, said obstruction forming a chain of paintballs that backs up into the passage, thereby causing the first wheel and, thus, the frame to climb up the chain of paintballs to the upper position.

19. The gun of claim 18 wherein the means for cutting-off electric power comprises a switch mechanism interconnected between the battery and the electric motor, said switch mechanism controlling connection of electric power to the electric motor in response to movement of the frame between the lower and upper positions, said switch mechanism connecting electric power to the electric motor when the frame is in the lower position and disconnecting electric power to the electric motor when the frame is in the upper position.

20. The gun of claim 19 wherein the first and second wheels are cylindrical and the deformable material composing the first and second surfaces is neoprene.

* * * * *